US006053284A

United States Patent [19]

Fountain

[11] Patent Number: 6,053,284

[45] Date of Patent: Apr. 25, 2000

[54] SUPPORT FRAME FOR A LADDER

[76] Inventor: John W. Fountain, 93 Franklin St., Malone, N.Y. 12853

[21] Appl. No.: 09/024,657

[22] Filed: Feb. 17, 1998

Related U.S. Application Data

[60] Provisional application No. 60/038,837, Feb. 18, 1997.

[51] Int. Cl.[7] ..... E06C 1/14

[52] U.S. Cl. ..... 182/180.2; 182/180.3

[58] Field of Search ..... 182/180.2, 180.3, 182/204

[56] References Cited

U.S. PATENT DOCUMENTS 4,671,383 6/1987 Huang ..... 182/204
5,370,204 12/1994 Fox ..... 182/180.3 X
5,645,140 7/1997 Mouneimneh ..... 182/180.3 X

*Primary Examiner*—Daniel P. Stodola
*Assistant Examiner*—Hugh B. Thompson
*Attorney, Agent, or Firm*—Marvin S. Towsend

[57] ABSTRACT

A support kit supports a free-standing ladder. The kit includes a support frame with adjustable legs to keep the support frame level and a ladder-receiving bracket pivotally mounted on the frame about an axis extending laterally of the frame. A set of struts is pivoted to the frame spaced from the ladder-receiving bracket and extend to connect to the ladder-receiving bracket to form a structural triangle. Another set of struts is pivoted about a lateral axis spaced from the first set of struts and extends to a strut-receiving bracket mounted to the ladder above the ladder-receiving bracket to form a second structural triangle.

5 Claims, 7 Drawing Sheets

SUPPORT FRAME FOR A LADDER

This application claims benefit of U.S. Provisional Application Ser. No. 60/038,837 filed on Feb. 18, 1997.

BACKGROUND OF THE INVENTION

1. Field of the Invention

The present invention relates to a support frame for a ladder and, in particular, to a frame having a two-dimensional horizontal component and a vertical component for supporting a standard extension ladder or the like.

2. Description of the Prior Art

Many accidents are caused on construction sites or in domestic environments with the use of conventional extension ladders or straight ladders. The foot of the ladder, particularly when used out of doors, often has one side rail which is unstable because of the unevenness of the terrain. Since the top end of the ladder, which usually leans against a wall, is not supported other than on the surface of the wall, it is subject to sliding sideways, particularly when the weight of a person is near the top of the ladder.

SUMMARY OF THE INVENTION

It is an aim of the present invention to provide a portable support structure for fully supporting an extension ladder or straight ladder.

A construction in accordance with the present invention comprises a support frame having a longitudinal axis and a lateral axis, a ladder-receiving bracket pivotally mounted on the support frame for pivoting movement about a lateral axis relations to the support frame. At least one support strut is pivotally mounted about a lateral axis, to the support frame, and is spaced on the support frame from the pivot axis of the ladder-receiving bracket, the strut having a free end to be connected to the pivoting bracket for forming a structural triangle between the support frame, the ladder-receiving bracket and the strut, wherein the ladder, with the foot inserted in the ladder-receiving bracket, will be supported with improved stability.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
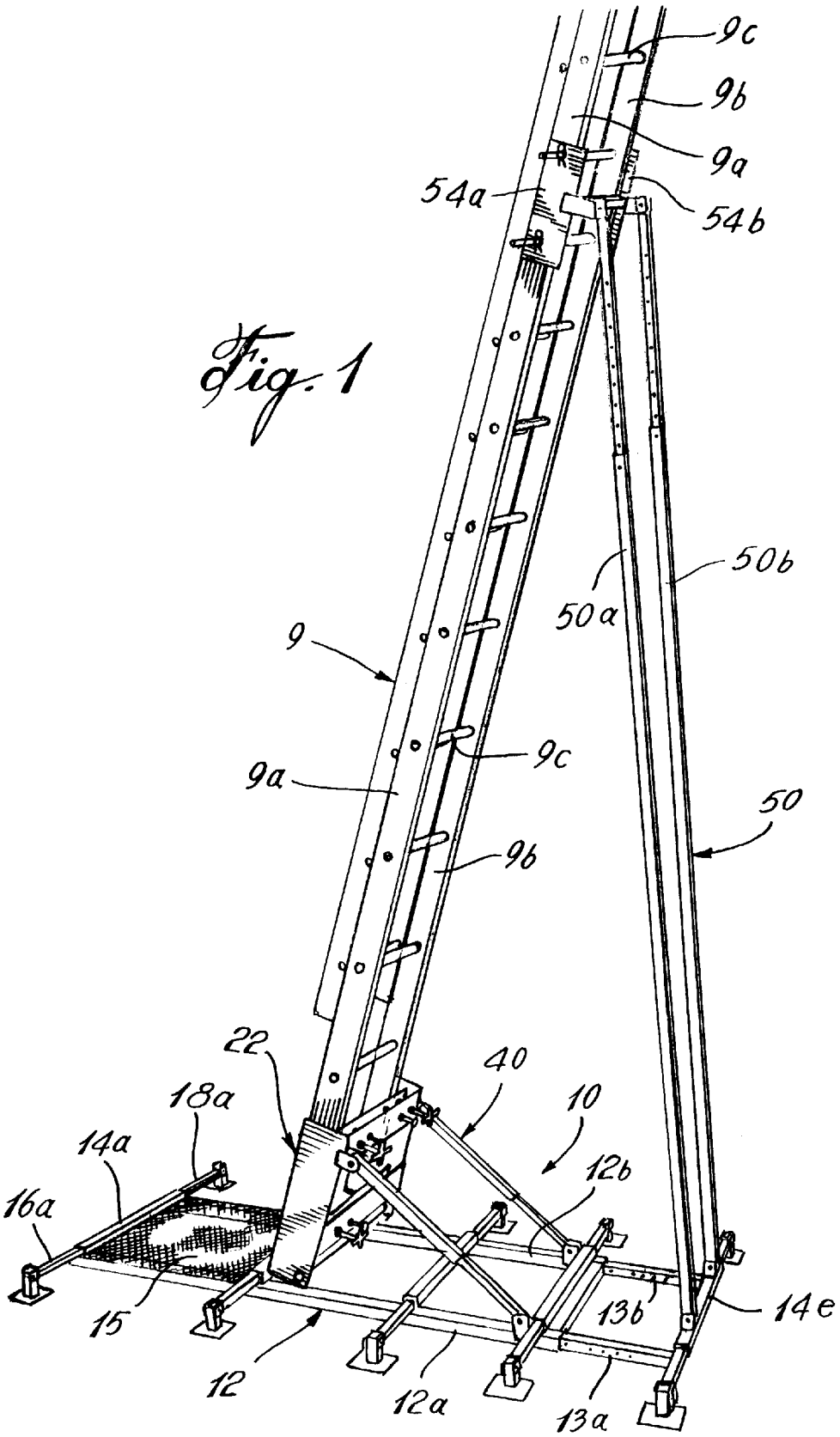
FIG. 1 is a perspective view of an embodiment of the present invention.

Referring now to the drawings, an extension ladder 9 is shown having side rails 9*a* and 9*b* as well as rungs 9*c*. The extension ladder is shown mounted on a support frame 10 in accordance with an embodiment of the present invention. The support frame 10 includes a pair of longitudinal, parallel, spaced frame members 12*a* and 12*b* to which are welded lateral square tubular members 14*a* through 14*e*. The longitudinal members 12*a* and 12*b* and lateral members 14*a* through 14*e* form the core of the platform 12.

Lateral extensions 16*a* through 16*e* and 18*a* through 18*e* telescope within respective box frame members 14*a* through 14*e*. For instance, lateral telescopic extension 16*a* slides within the lateral square tubular member 14*a* at one end thereof while extension 18*a* telescopes at the other end of the frame member 14*a*. Each extension member 16*a* and 18*a* is provided with a plurality of spaced apart holes 19 which can be engaged by pins or bolt and nut devices 20 which pass through the square tubing of frame member 14*a* to thereby lock the extension 16*a* or 18*a* at the desired extended or retracted position.

Typically the width of the platform 12 is 22" while the extensions 16 and 18 are preferably set so that the total width of the frame is 26". The platform 12 can be extended laterally by means of extensions 16 and 18 to a maximum of 40".

A shoe 21 is fixed to the end of each extension 16 or 18. The embodiment, which is shown in FIGS. 1 and 2, is suitable for an even horizontal deck, such as interior flooring or a paved outdoor surface.

The frame members 12*a* and 12*b* can be extended longitudinally by means of sliding members 13*a* and 13*b* to which is mounted a lateral member 14*e*. Extensions 13*a* and 13*b* extend from the longitudinal square tubular frame members 12*a* and 12*b* and can be locked in the same manner as extension members 15 and 18.

The ladder-receiving clamping bracket 22 includes side members 24 and 26 and front and rear plates 28*a*, 28*b*, 30*a*, and 30*b*. These components form a rectangular box-like enclosure for receiving the side rails 9*a* and 9*b* of a typical ladder. Clamp plates 32*a* and 32*b* are mounted on guide pins 34 which pass through the rear plates 30*a* and 30*b*. Threaded stems 36 with handles are operative to move the clamp plates 32*a* and 32*b* relative to the rear plates 30*a* and 30*b* in order to securely clamp the side rails 9*a* and 9*b* within the clamping bracket 22.

Figure 2:
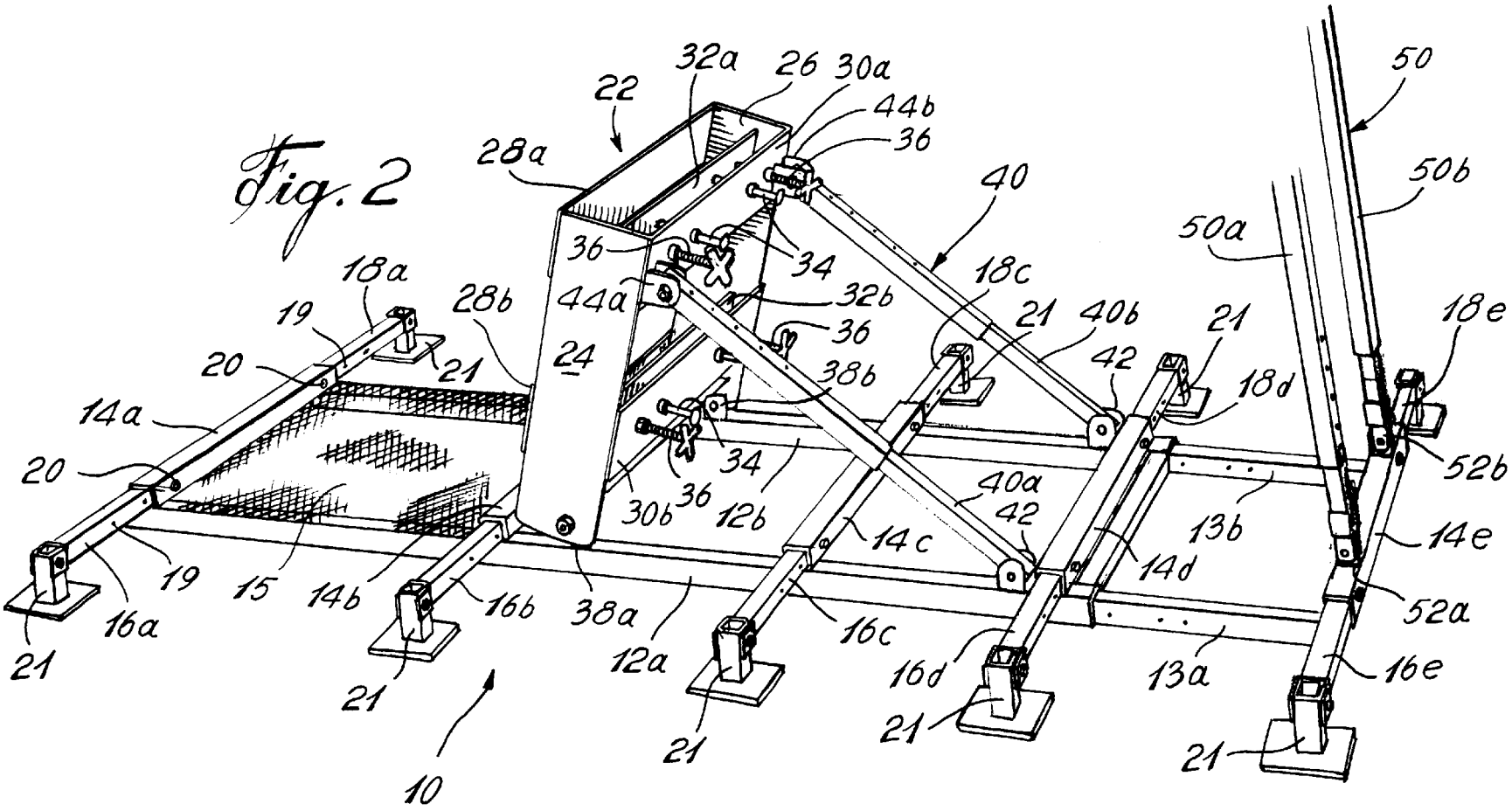
FIG. 2 is an enlarged fragmentary view of the support structure in accordance with the embodiment shown in FIG. 1.

As shown in FIG. 2, the clamping bracket 22 is pivoted about a lateral axis in pivot brackets 38*a* and 38*b*. There are two pairs of struts. The pair of struts 40 includes telescopic struts 40*a* and 40*b* pivoted by means of pivot brackets 42 to respective longitudinal frame members 12*a* and 12*b*. The other ends of struts 40*a* and 40*b* are pivoted to the clamping bracket 22 at pivot brackets 44*a* and 44*k*. The struts 40*a* and 40*b* can be extended telescopically and locked in a fixed position in the same manner as extension members 16 and 18.

Figure 4:
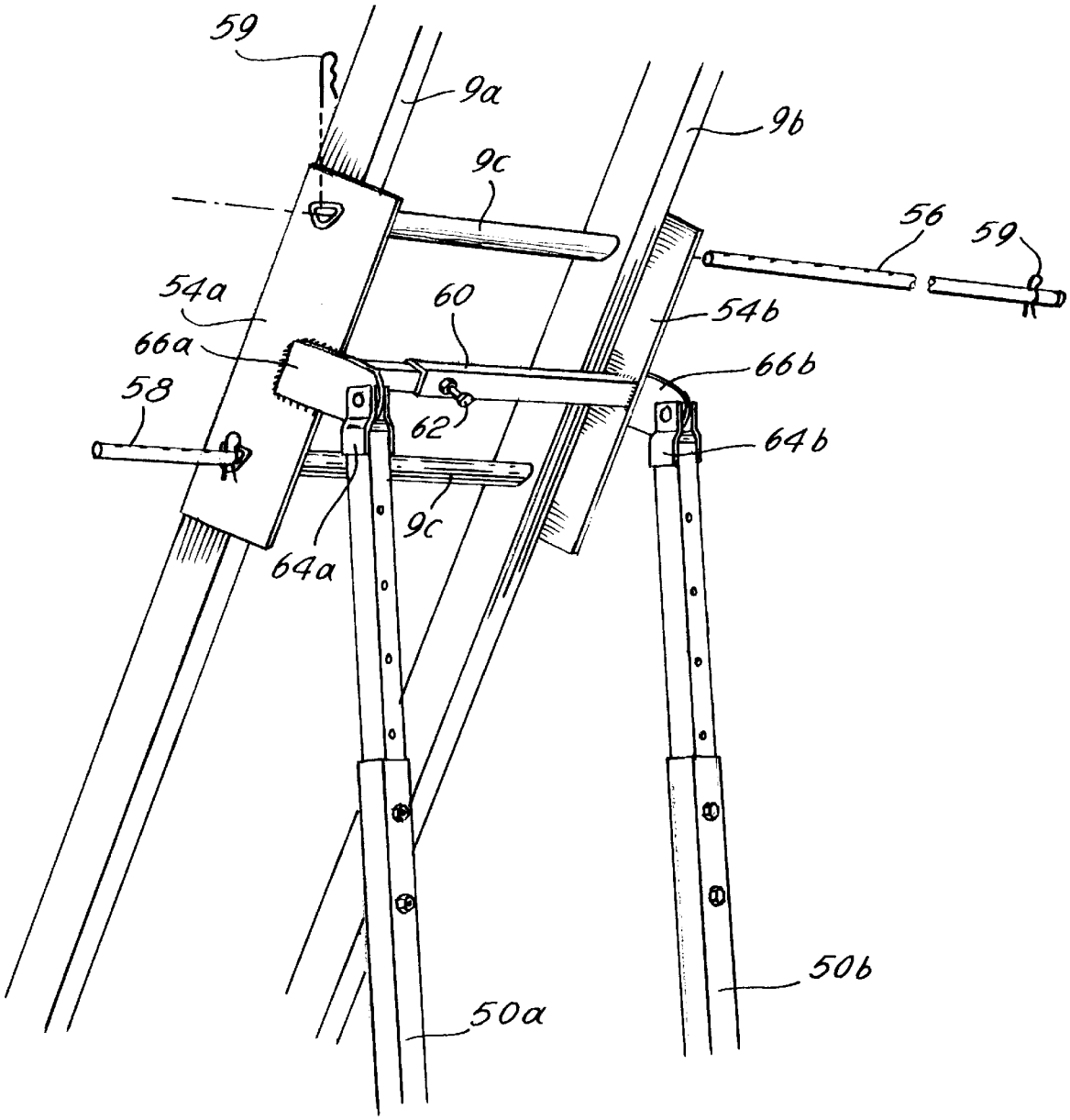
FIG. 4 is an enlarged perspective fragmentary view of another detail of the support structure shown in FIG. 1.

A second pair of struts 50 includes struts 50*a* and 50*b*. Struts 50*a* and 50*b* are pivotally mounted to brackets 52*a* and 52*b* on the lateral frame member 14*e*. Struts 50*a* and 50*b* are telescopic and can be adjusted in the same manner as extensions 16 and 18. As shown in FIG. 4, a pair of plates 54*a* and 56*a* are adapted to be mounted on respective side rails 9*a* and 9*b*. The plates may have openings conforming to a typical rung cross-section, and rods 56 and 58 extend through the hollow rungs 9*c* through the openings in the plates 54*a* and 56*a*. Lock pins 59 hold the plates 54 and 56 on respective rods 56 and 58. A telescopic leg 60 extends between the plates 54 and 56 may be locked in place by a set screw 62. Pivot brackets 64*a* and 64*b* are provided at the end of struts 50*a* and 50*b* and are pivotally connected to tabs 66*a* and 66*b* mounted respectively on side plates 54*a* and 54*b*.

Figure 3:
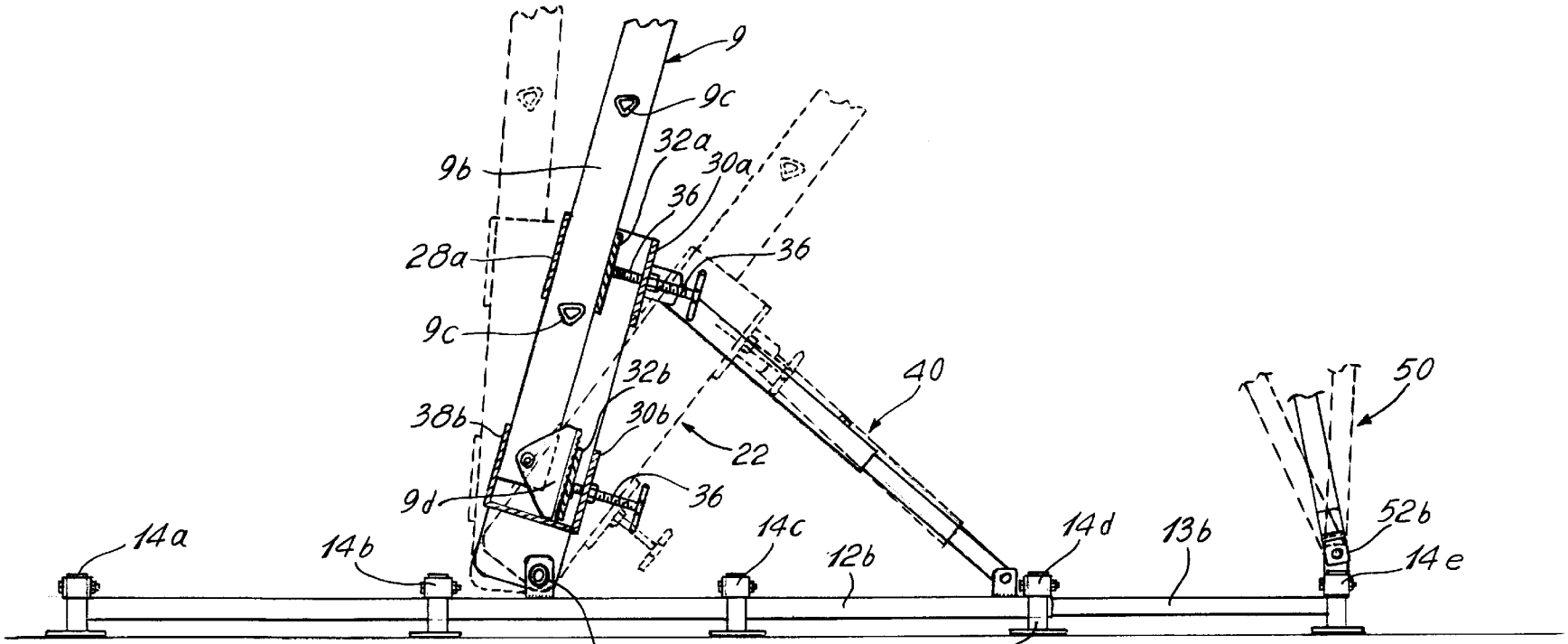
FIG. 3 is a side elevation, partly in cross-section, of the support structure in accordance with the embodiment shown in FIGS. 1 and 2.

Thus, when using this support structure for supporting a typical extension ladder 9 or a straight ladder, the foot of the ladder is inserted in the clamping bracket 22, and the clamp plates 32*a* and 32*b* are adjusted against the side rails 9*a* and 9*b* of the ladder, as shown in FIGS. 2 and 3. In FIG. 3, shoes 9*d* are shown being engaged by the clamp plate 32*b*. The typical width of a ladder is 17", and it would normally fit comfortably in the clamping bracket 22 which has an overall width of 22". The ladder may be leaning against the wall at a preferred angle of 75°, and the pairs of struts 40 and 50 are then adjusted to the angle of the ladder. Plates 54*a* and 54*b* are mounted to side rails 9*a* and 9*b* at a suitable height of the ladder, and struts 50*a* and 50*b* extend so that brackets 54*a* and 54*b* can be pivotally connected to the tabs 66*a* and 66*b* respectively.

In a preferred embodiment, a plate or expanded metal screen 15 is mounted on platform 12 of the support frame 10 for stepping onto the first rung of the ladder.

Figure 5:
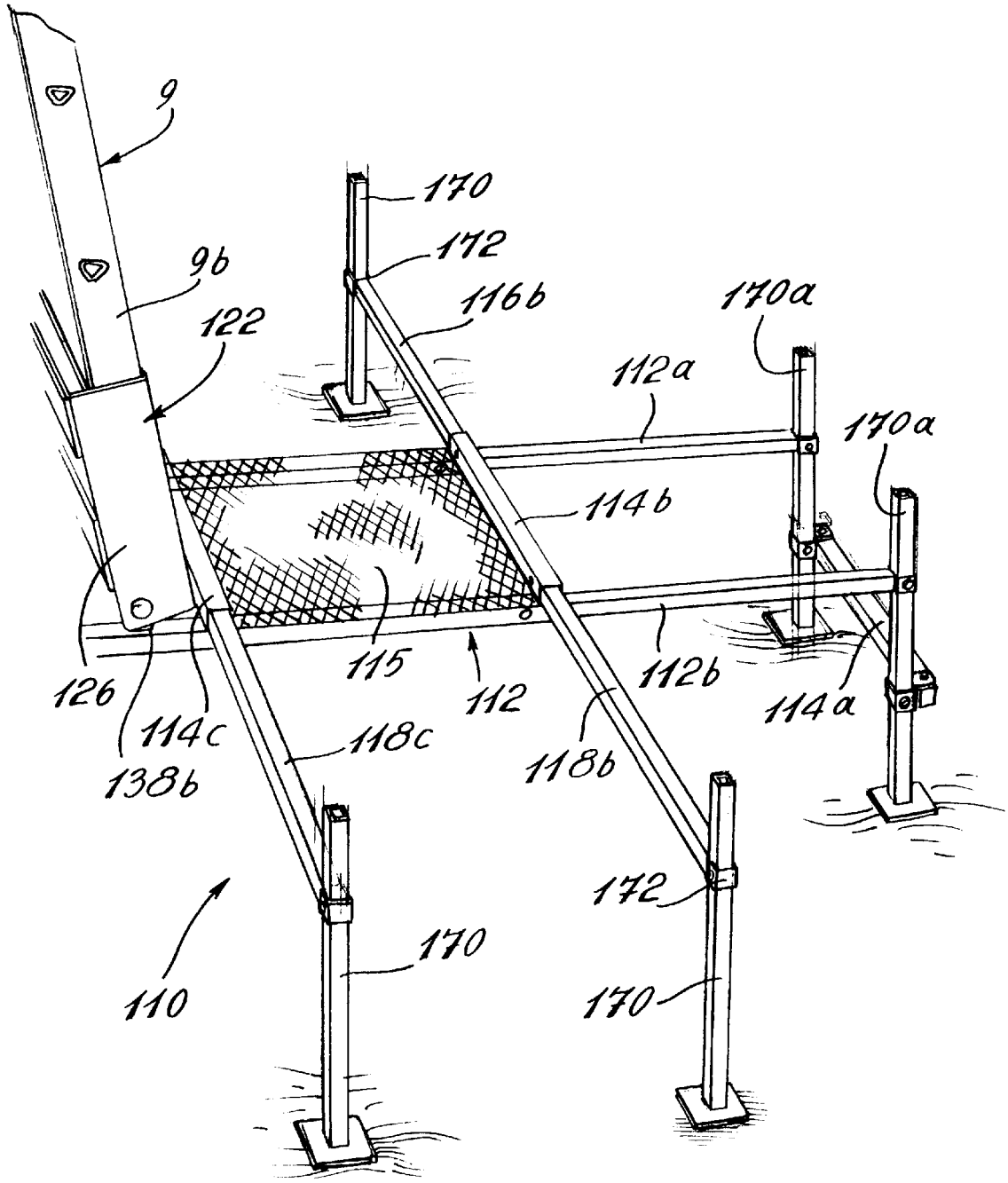
FIG. 5 is a fragmentary perspective view of another embodiment of the present invention.
Figure 6:
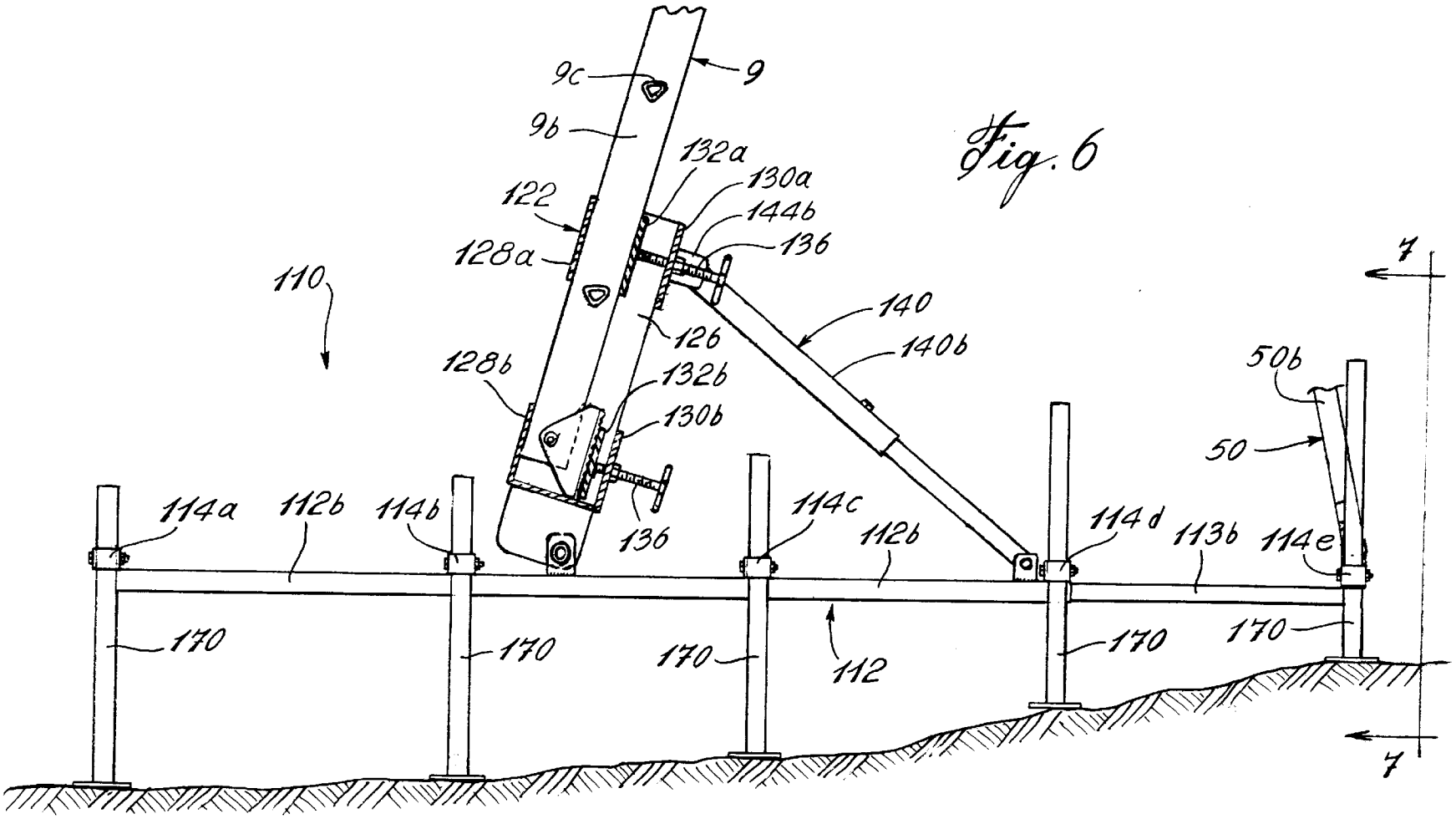
FIG. 6 is a side elevation, partly in cross-section, of the support structure in accordance with the embodiment shown in FIG. 5.
Figure 7:
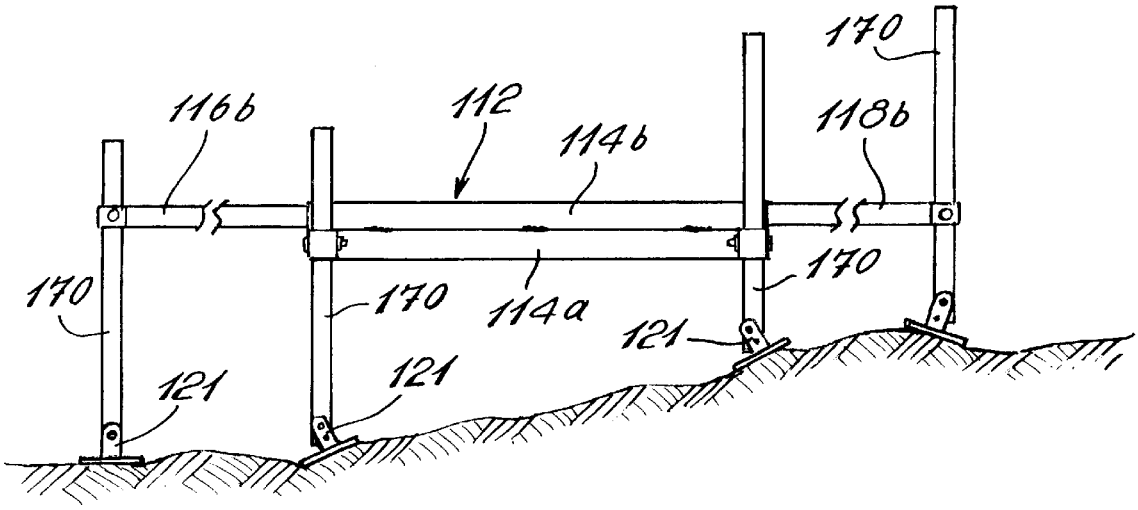
FIG. 7 is a fragmentary end elevation taken along line 7—7 in FIG. 6, showing a detail of the support structure in accordance with the embodiment of FIGS. 5 and 6.

Referring now to the embodiments shown in FIGS. 5 through 7, reference numerals are raised by 100 to identify elements which correspond to elements identical in the embodiment shown in FIGS. 1 through 4.

The support frame 110, as shown in FIGS. 5 and 6, includes a frame member or platform 112 with longitudinal frame members 112*a* and 112*b* to which are welded the lateral frame members 114*a* to 114*e*. However, the ends of the extension members 116 and 118 are provided with legs 170 which can be adjusted vertically. At the end of extension 116*b*, a socket 172 is provided to receive the square tubing of leg 170. Bolts and nuts can be passed through the socket 172 to engage spaced-apart opening in the foot 170. Thus, on uneven terrain, the platform 112 can be adjusted so that it is horizontal and level.

As shown in FIG. 5, the lateral member 114*a* may extend between the leg 170*a* in order to provide additional lateral stability. As far as the support frame 110 and the pivoting bracket 122 are concerned, the structure is essentially the same as in relation to FIGS. 1 to 4.

FIG. 7 shows that the shoes 121 can be pivotally mounted to the ends of feet 170 to enhance the contact with an uneven terrain.

Figure 8:
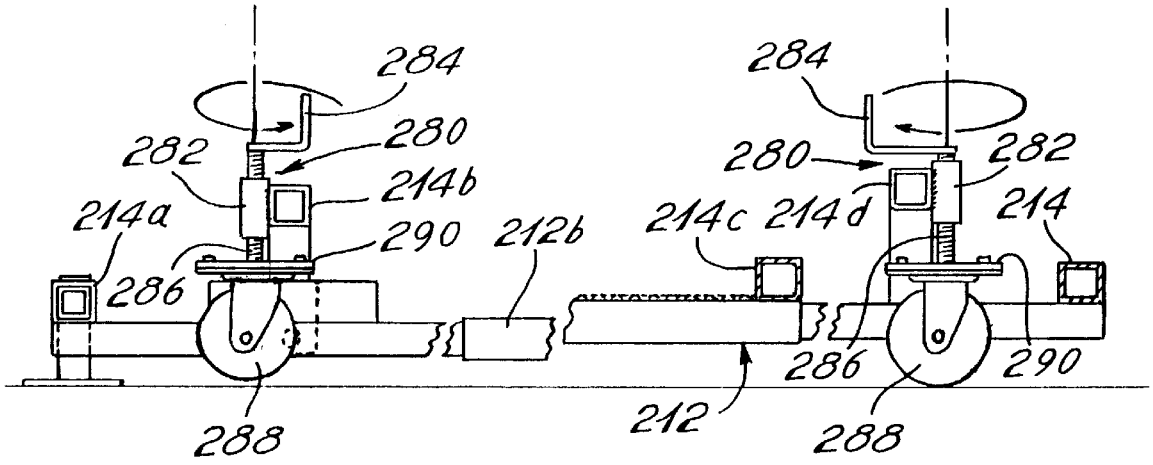
FIG. 8 is a fragmentary enlarged longitudinal cross-section of a further embodiment of the present invention.

FIG. 8 shows essentially the support frame of the embodiment shown in FIGS. 1 to 4 and corresponding reference numerals have been raised by 200. In the embodiment of FIG. 8, the lateral frame members 214*b* and 214*d* have been raised on short extensions welded to the longitudinal frame members 212*a* and 212*b*. Threaded sleeves 282 are welded to the lateral frame members 214*b* and 214*d*, and a threaded stem 286 can move vertically in the sleeve 282. A handle 254 is provided at the top end of the stem 286 in order to move the stem vertically. The other end of the stem 286 is provided with a reinforced swivel plate 290 to which swivel caster wheels 288 have been mounted.

Thus, in the event that the support frame of FIGS. 1 to 4 needs to be moved from one location to another on an even floor or outside pavement, the wheels 288, and there would be two wheels near each end of the support frame, are lowered to engage the flooring and to raise the support frame of the floor so that it can be pushed around.

I claim:

1. A support kit for a ladder that has a pair of parallel side rails and spaced-apart rungs extending therebetween, the support kit comprising a support frame-having a longitudinal axis and a lateral axis, a ladder-receiving bracket pivotally mounted on the support frame for pivoting movements about a lateral axis relative to the support frame, the ladder-receiving bracket including front and rear wall members parallel to the lateral axis defining a space therebetween for receiving and securing the side rails of the ladder, at least a first support strut pivotally mounted about a lateral axis to the support frame and spaced, on the support frame, from the pivot axis of the ladder-receiving bracket, the first support strut having a free end to be connected to the ladder-receiving bracket for forming a structural triangle between the support frame, the ladder-receiving bracket, and the first support strut, in a vertical plane, wherein the ladder will be supported, with the side rails thereof inserted in the ladder-receiving bracket.

2. The ladder support kit as defined in claim 1, wherein the support frame includes a frame member, the frame member extends in the longitudinal axis beyond the front and rear walls of the ladder-receiving bracket, the frame member extending in a plane and the support frame including at least four leg members extending downwardly from the frame member when the support frame is placed on the ground and each leg member is independently adjustable to and away from the plane of the frame member whereby the frame member can be stabilized in a horizontal plane.

3. The ladder support kit as defined in claim 2, wherein the support frame includes a plurality of laterally extending tubular members rigidly connected to the frame member, the tubular members being spaced-apart longitudinally of the support frame, telescopically extending outriggers slidably mounted in the tubular members on the frame member to extend laterally on either side of the support frame, and said legs are provided one at each end of each outrigger.

4. The ladder support kit as defined in claim 2, wherein the frame member includes longitudinal frame elements that are telescopically extendable and retractable.

5. The ladder support kit as defined in claim 1, wherein a strut-receiving bracket may be mounted to the side rails of the ladder at a location on the ladder spaced from the ladder-receiving bracket, and wherein at least a second support strut is pivotally mounted about a lateral axis to the support frame, and wherein a free end of the second support strut is connected to the ladder-mounted-strut-receiving bracket for forming a second structural triangle between the support frame, the second support strut, the ladder, and the ladder-receiving bracket in a vertical plane.

* * * * *